US005384930A

United States Patent [19]

Uno

[11] Patent Number: 5,384,930

[45] Date of Patent: Jan. 31, 1995

[54] PUSH BROOMS WITH FLEXIBLE COUPLINGS IN THE HANDLES

[76] Inventor: Thomas A. Uno, 606 Kawainui St., Kailua, Hi. 96734

[21] Appl. No.: 208,233

[22] Filed: Mar. 10, 1994

[51] Int. Cl.[6] ..... A46B 5/00

[52] U.S. Cl. ..... 15/159.1; 15/143.1; 15/144.1; 116/212; 116/DIG. 34; 403/27; 403/229; 403/268

[58] Field of Search ..... 15/143.1, 144.1, 144.2, 15/159.1, 172; 16/110 R; 116/212, DIG. 34; 403/27, 220, 229, 268, 283, 298

[56] References Cited

U.S. PATENT DOCUMENTS

| | | | |
|---|---|---|---|
| 483,477 | 9/1892 | Ryan | 403/229 |
| 500,059 | 6/1893 | Forsyth, Jr. | 403/229 |
| 634,637 | 10/1899 | Allen | 403/229 |
| 637,668 | 11/1899 | Rison | 403/229 |
| 642,873 | 2/1900 | Palmer | 403/220 |
| 1,085,505 | 1/1914 | Stafford | 403/229 |
| 1,183,181 | 5/1916 | Fischer, Jr. | 403/283 |
| 1,977,180 | 10/1934 | Forbes | 403/229 |
| 2,095,918 | 10/1937 | Cave | 403/229 |
| 2,279,995 | 4/1942 | Jones | 403/283 |
| 2,980,457 | 4/1961 | Page | 403/229 |
| 3,602,186 | 8/1971 | Popenoe | 116/DIG. 34 |
| 4,681,477 | 7/1987 | Fischer | 403/268 |
| 4,785,489 | 11/1988 | Von Doehren | 403/229 |

FOREIGN PATENT DOCUMENTS

| | | | |
|---|---|---|---|
| 437326 | 11/1926 | Germany | 403/229 |
| 2521007 | 11/1976 | Germany . | |
| 17388 | 7/1914 | United Kingdom | 403/229 |

*Primary Examiner*—David A. Scherbel
*Assistant Examiner*—Mark Spisich
*Attorney, Agent, or Firm*—Michael J. Colitz, Jr.

[57] ABSTRACT

A broom with a flexible coupling in the handle comprising a head having a threaded aperture therein. A handle is formed as a long upper section adapted to be held by a user and a shorter lower section being provided with screw threads for releasably coupling with the threaded aperture in the head. A coil spring couples the lower end of the upper section with the upper end of the lower section with the spring encompassing a space between the lower end of the upper section and the upper end of the lower section. The coupling may further include an adhesive in a rupturable membrane to provide a more secure attachment and a dye in a similar membrane for indicating proper attachment.

5 Claims, 5 Drawing Sheets

PUSH BROOMS WITH FLEXIBLE COUPLINGS IN THE HANDLES

BACKGROUND OF THE INVENTION

1. Field of the Invention

The present invention relates to push brooms with flexible couplings in the handles and more particularly pertains to flexing the handles of push brooms adjacent to the head for increasing the utility of the broom.

2. Description of the Prior Art

The use of broom handles is known in the prior art. More specifically, broom handles heretofore devised and utilized for the purpose of cleaning floors with brooms having nonrigid couplings between the head and the handle are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,194,259 to Bauman discloses an attachment means for industrial push broom handles.

U.S. Pat. No. 4,785,489 to Von Doehren discloses a resilient broom and scraper.

U.S. Pat. No. 4,499,626 to Schneider discloses a broom handle holding attachment for an industrial broom.

U.S. Pat. No. 4,550,829 to Strahs discloses a spring clip for push brooms.

Lastly, U.S. Pat. No. 5,094,564 to Tedrick discloses a push broom handle clamp.

In this respect, the push brooms with flexible couplings in the handles according to the present invention substantially departs from the conventional concepts and designs of the prior art, and in doing so provides an apparatus primarily developed for the purpose of flexing the handles of push brooms adjacent to the head for increasing the utility of the broom.

Therefore, it can be appreciated that there exists a continuing need for new and improved push brooms with flexible couplings in the handles which can be used for flexing the handles of push brooms adjacent to the head for increasing the utility of the broom. In this regard, the present invention substantially fulfills this need.

SUMMARY OF THE INVENTION

In view of the foregoing disadvantages inherent in the known types of broom handles now present in the prior art, the present invention provides an improvement in push brooms with flexible couplings in the handles. As such, the general purpose of the present invention, which will be described subsequently in greater detail, is to provide a new and improved push brooms with flexible couplings in the handles and method which has all the advantages of the prior art and none of the disadvantages.

To attain this, the present invention essentially comprises a new and improved push broom with a flexible coupling in the handle comprising a head having a block at its upper extent and bristles at its lower extent, the block having a planar upper surface with a threaded aperture located at an angle offset from the perpendicular to the upper surface. A handle is formed as a rigid elongated cylindrical member having a long upper section adapted to be held by a user and having a short lower section, the lower end of the lower section being provided with screw threads for releasably coupling with the threaded aperture in the head, the lower end of the upper section being positioned proximate to the upper end of the lower section in alignment along a common axis with the facing ends thereof perpendicular to the common axis. A coil spring couples the lower end of the upper section with the upper end of the lower section, the spring having an upper extent frictionally receiving the lower extent of the upper section and a lower extent frictionally receiving the upper extent of the lower section with a central section of the spring located to encompass a space between the lower end of the upper section and the upper end of the lower section, the middle portion of the spring constituting about one third of the length of the entire spring. A plurality of teeth are formed into the spring in its area of engagement with its associated handle section. An adhesive bubble is formed of a rupturable membrane extending between the teeth of the spring with an adhesive liquid located therein adapted to be released upon the coupling of the spring to its associated handle section for the adhesive coupling therebetween. A dye bubble is formed of a rupturable membrane extending between an outer most tooth of the spring and an adjacent wall of the spring with a dye located therein whereupon securement of the spring to its associated handle section will break the rupturable member and release the dye to provide an indication that the spring is properly coupled to the handle section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is further object of the present invention to provide new and improved push brooms with flexible couplings in the handles which are of durable and reliable constructions.

An even further object of the present invention is to provide new and improved push brooms with flexible couplings in the handles which are susceptible of a low cost of manufacture with regard to both materials and labor, and which accordingly are then susceptible of low prices of sale to the consuming public, thereby making such push brooms with flexible couplings in the handles economically available to the buying public.

Still yet another object of the present invention is to provide new and improved push brooms with flexible couplings in the handles which provide in the apparatuses and methods of the prior art some of the advantages thereof, while simultaneously overcoming some of the disadvantages normally associated therewith.

Even still another object of the present invention is to flex the handles of push brooms adjacent to the head for increasing the utility of the broom.

Lastly, it is an object of the present invention to provide new and improved brooms with flexible couplings in the handles comprising a head having a block at its upper extent and bristles at its lower extent, the block having a planar upper surface with a threaded aperture located at an angle offset from the perpendicular to the upper surface. A handle formed as a rigid elongated cylindrical member having a long upper section adapted to be held by a user and having a short lower section, the lower end of the lower section being provided with screw threads for releasably coupling with the threaded aperture in the head, the lower end of the upper section being positioned proximate to the upper end of the lower section in alignment along a common axis with the facing ends thereof perpendicular to the common axis. A coil spring coupling the lower end of the upper section with the upper end of the lower section, the spring having an upper extent frictionally receiving the lower extent of the upper section and a lower extent frictionally receiving the upper extent of the lower section with a central section of the spring located to encompass a space between the lower end of the upper section and the upper end of the lower section, the middle portion of the spring constituting about one third of the length of the entire spring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
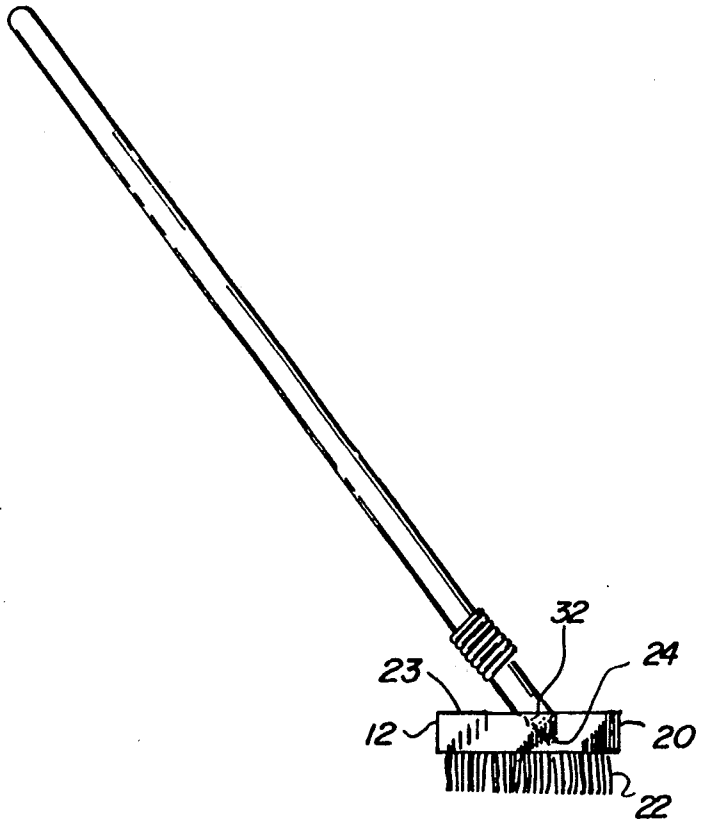
FIG. 2 is a side elevational view of the broom shown in FIG. 1.
Figure 1:
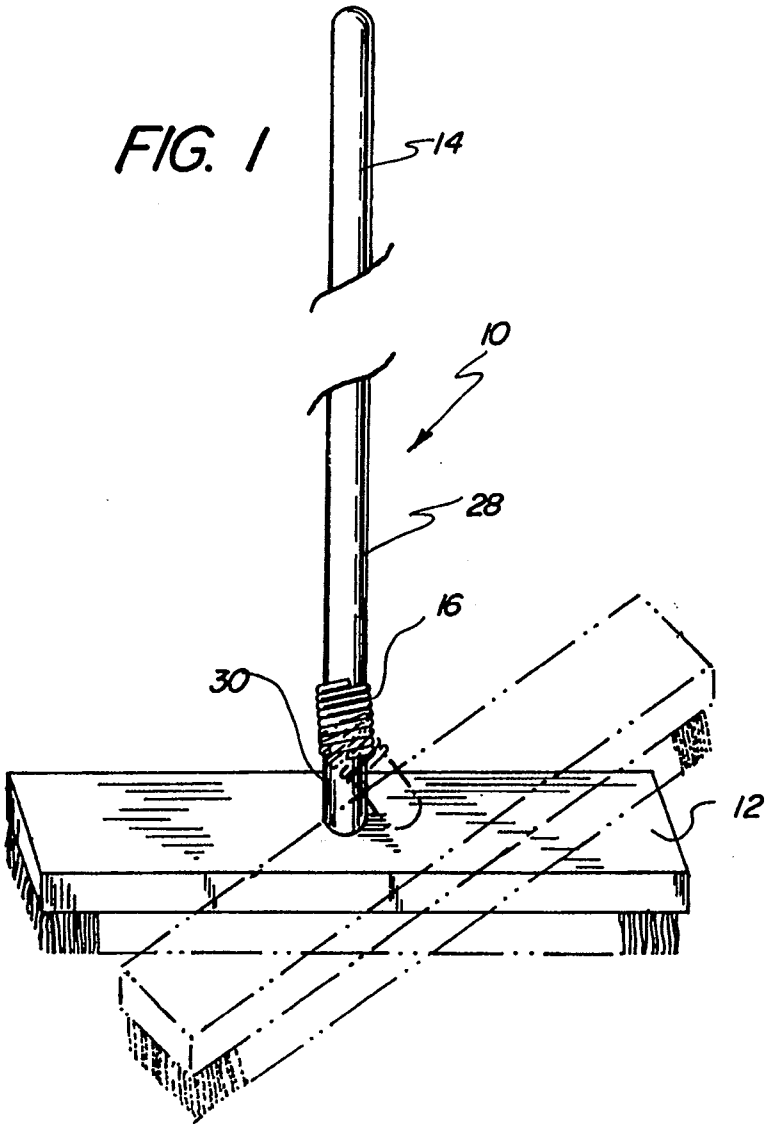
FIG. 1 is a front elevational view of the preferred embodiment of the push brooms with flexible couplings in the handles constructed in accordance with the principles of the present invention.
Figure 3:
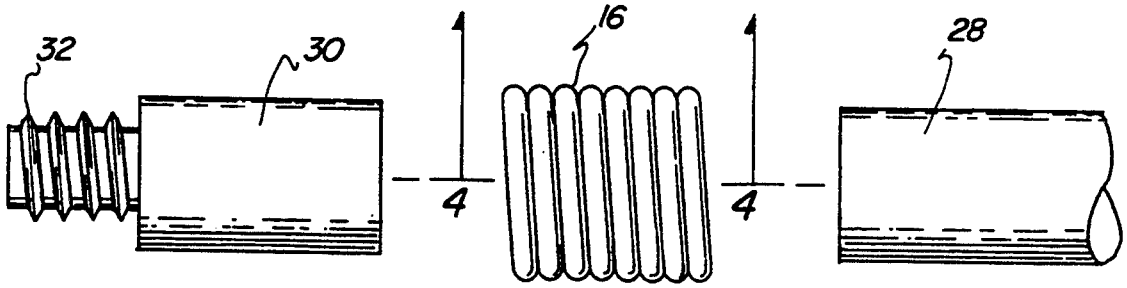
FIG. 3 is an exploded perspective view of the area of coupling between the handle and broom.
Figure 4:
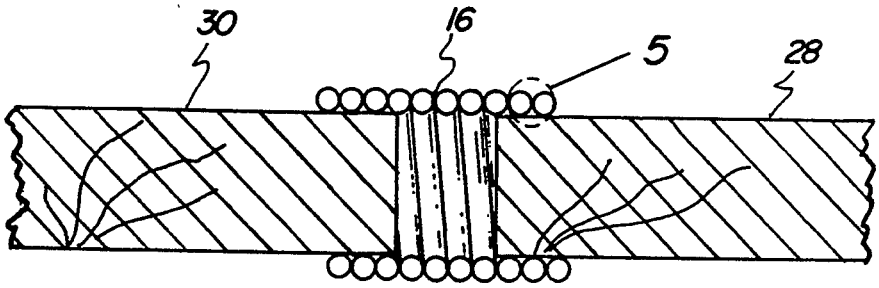
FIG. 4 is a cross sectional view taken along line 4–4 of FIG. 3.

With reference now to the drawings, and in particular to FIG. 1 thereof, the preferred embodiment of the new and improved push brooms with flexible couplings in the handles embodying the principles and concepts of the present invention and generally designated by the reference numeral 10 will be described.

Specifically, it will be noted in FIGS. 1 through 4, that there is provided a new and improved push broom 10 with a flexible coupling in the handle. The push broom 10, in its broadest context, comprises a head 12, a handle 14 and a flexible coupling 16.

More specifically, the head 12 has a block 20 at its upper extent. It also has bristles 22 extending down perpendicularly from the block at its lower extent. The block has a planar upper surface 23. A threaded aperture 24 is formed into the upper surface and is located at an angle offset from the perpendicular to the upper surface 23. Note in particular FIG. 2.

The second component of the push broom 10 is the handle 14. The handle is formed as a rigid elongated cylindrical member having a long upper section 28 and a short lower section 30. The upper section is adapted to be held by a user and includes a hemispherical upper end. The lower end of the lower section 30 is formed with screw threads 32. Such screw threads are for releasably coupling with the threaded aperture 24 in the head 12. The lower end of the upper section is positioned proximate to, but slightly spaced from the upper end of the lower section. The upper and lower sections of the handle are in alignment along a common axis. The facing ends of the upper and lower sections are cut parallel with each other and perpendicular to the common axis.

The third component of the system is the flexible coupling 16 which is formed as a coil spring. Such coil spring functions to couple the lower end of the upper section 28 with the upper end of the lower section 30. The upper extent of the spring is sized and shaped to fictionally receive the lower extent of the upper section.

The lower extent of the spring is sized and shaped to fictionally receive the upper extent of the lower section. A central section of the spring is located to encompass a space between the lower end of the upper section of the handle and the upper end of the lower section of the handle. the coil spring is of a common internal and external diameter throughout its length. The middle portion of the spring constitutes about one third of the length of the entire spring. Note FIG. 4.

Figure 5:
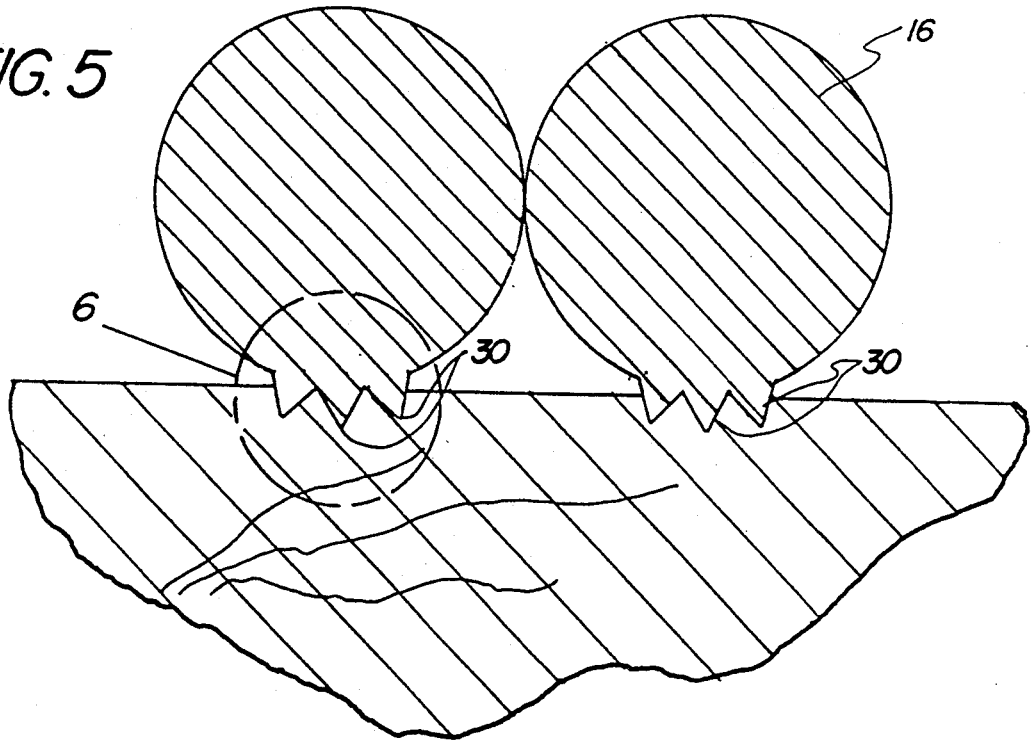
FIG. 5 is an enlarged showing of the coupling between the connector and handle taken at section 5 of FIG. 4.
Figure 6:
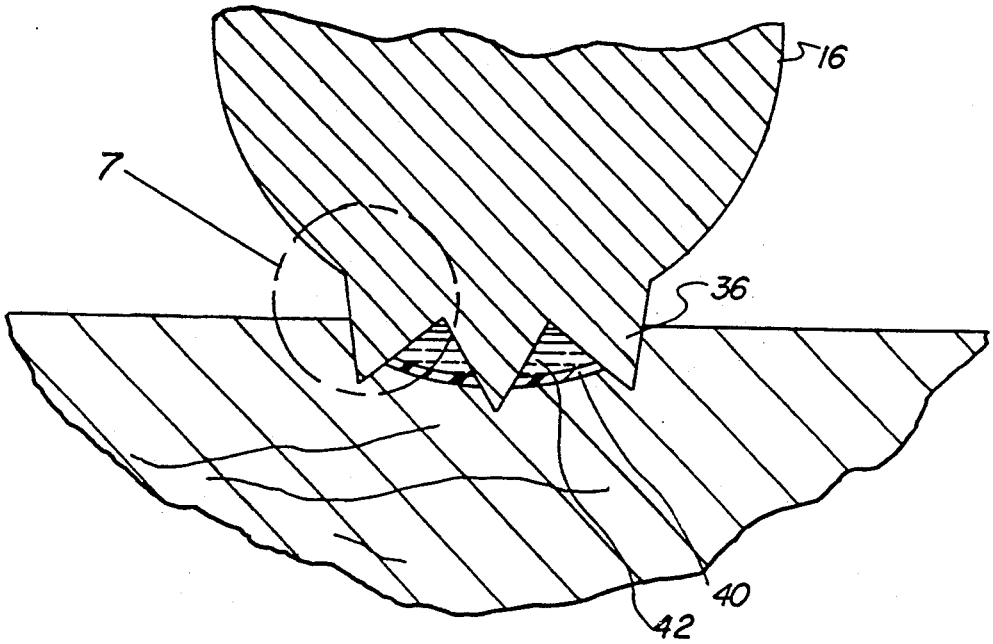
FIG. 6 is a further enlarged view taken at section 6 of FIG. 5 but illustrating an alternate embodiment of the invention.

An alternate embodiment of the invention is shown in FIGS. 5 and 6. In such embodiment, a plurality of teeth 36 are formed into the spring 16. Such teeth 36 are adapted to engage an area of the handle of coupling between the spring 16 and the handle section 28 or 30. Such teeth function to provide increased gripping between the spring and handle sections being coupled to improve the coupling therebetween.

In FIG. 5, an adhesive bubble is formed between the teeth 36. Such bubble is in the form of a rupturable membrane 40 extending between such teeth 36 of the spring 16. An adhesive liquid 42 is located in a space between the membrane 40 and teeth 36. The membrane is adapted to be released upon forces applied to the membrane during the coupling of the spring to its associated handle section. This provides an even more secure coupling between the spring and handle section.

Figure 7:
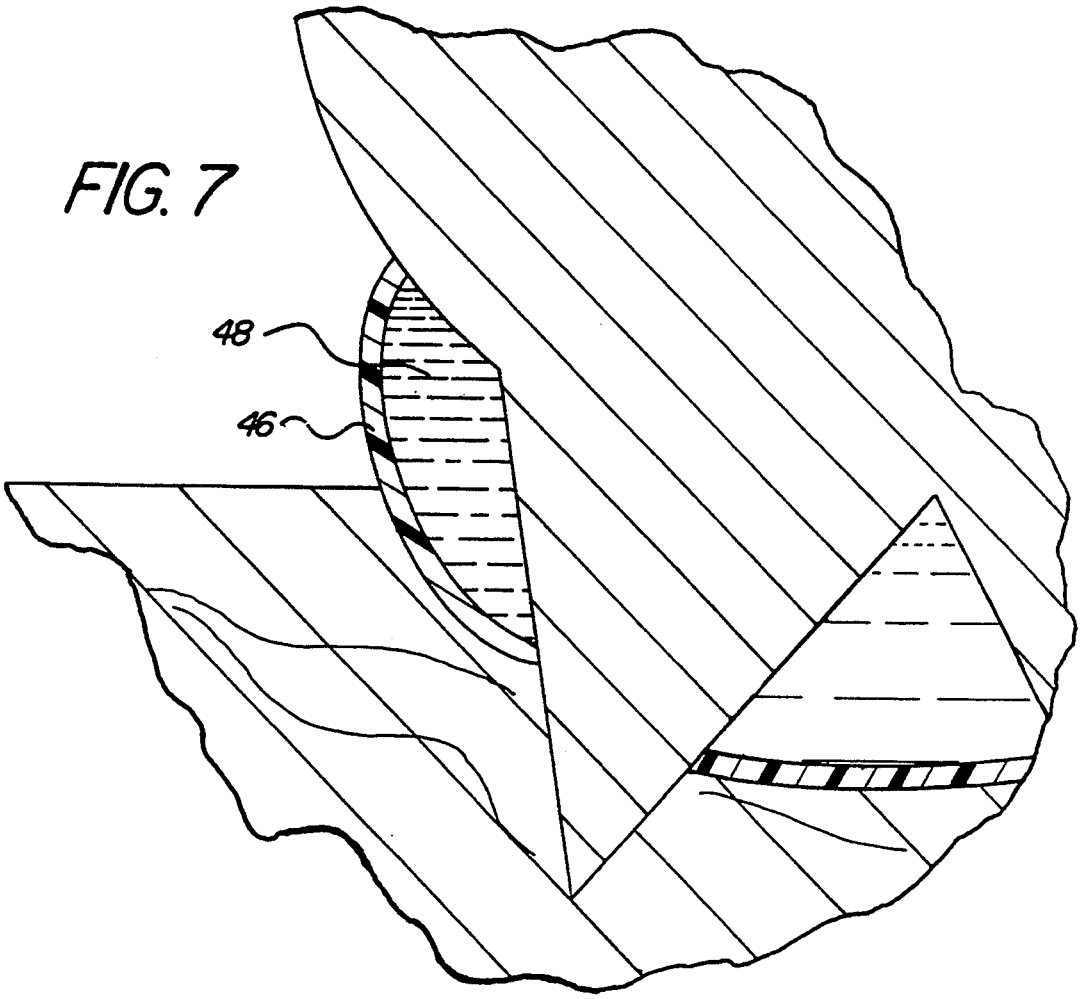
FIG. 7 is a yet further enlarged view of the area of coupling between the handle and head taken at section 7 of FIG. 6 but illustrating a further alternate embodiment of the invention.
Figure 8:
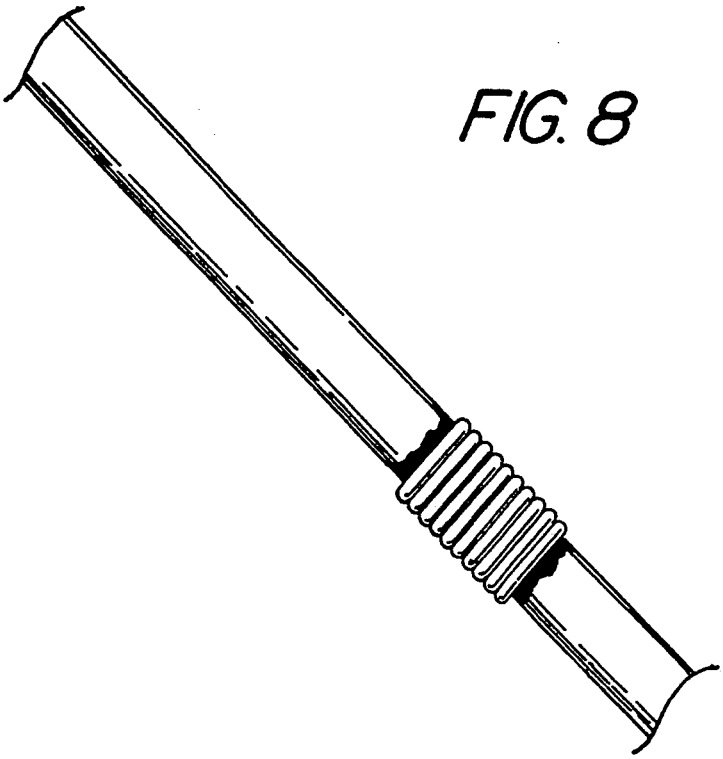
FIG. 8 is a side elevational view of the coupling between the handle sections illustrating the embodiment of FIG. 7.

The last alternate embodiment of the invention is shown in FIGS. 7 and 8. In this embodiment, a dye bubble is formed between the outer most tooth 36 of the spring 16 and an adjacent wall of the spring 16. The dye bubble is formed of a rupturable membrane 46 with a visible dye 48 located between the membrane and adjacent parts of the spring. In this manner, upon securement of the spring 16 to its associated handle sections 28 and 30 the membrane will break and thereby release the dye. This provides an indication that the spring is properly coupled to the handle section.

Figure 9:
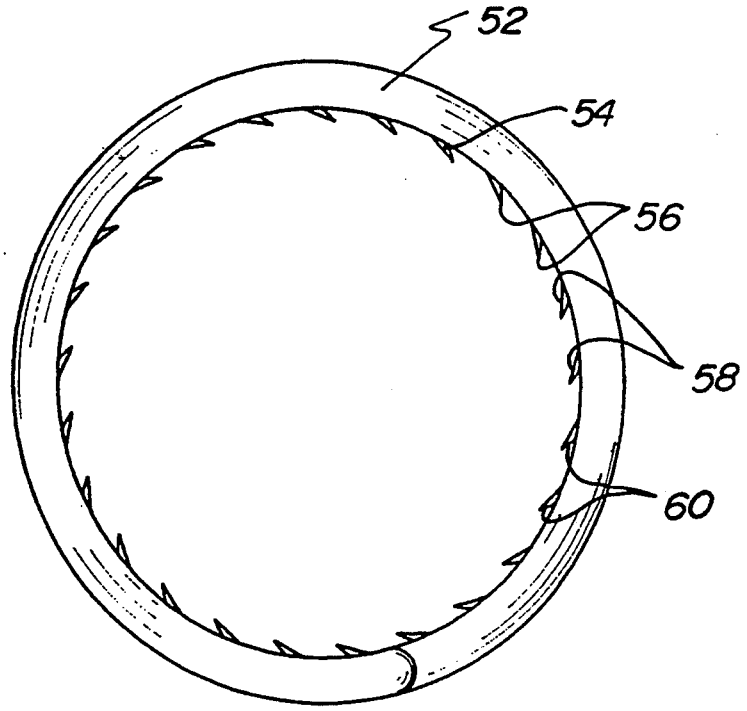
FIG. 9 is a front elevational view of a spring connector constructed with another alternate embodiment of the invention.
Figure 10:
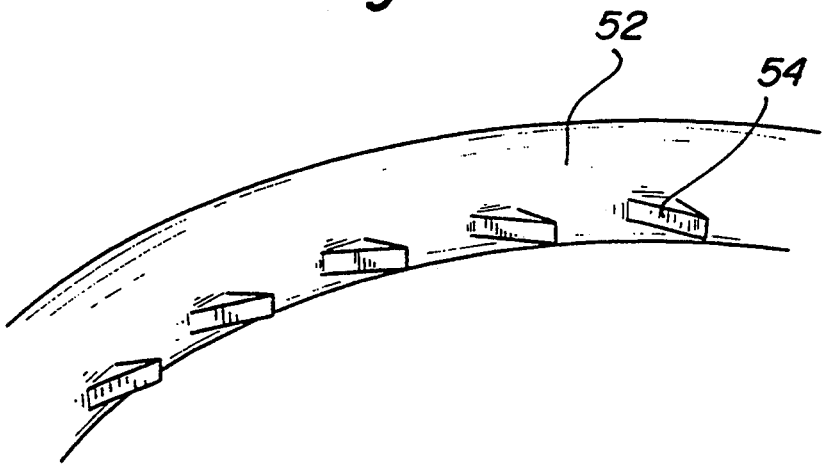
FIG. 10 is a perspective illustration of the barbs of the FIG. 9 embodiment.

FIGS. 9 and 10 illustrate yet another alternate embodiment of the invention. In such embodiment, the spring 52 is formed with radially inwardly facing barbs 54. The barbs are formed with points 56. Each barb 54 has a rearwardly directed face 58 to be in contact with the pole end to which it is to be coupled. Each barb 54 also has an undercut face 60 which allows the point 56 of the barb 54 to cut into the pole end in the event of a reverse rotation tending to remove the spring coupling to the pole end. In this manner a more secure coupling is created after the spring 52 has been screwed into operative relationship with the pole end for operation and use.

Using a broom to clear dirt and debris from any floor surface is a task that most people have performed at some point in time. One aspect of using a broom that makes the overall chore more difficult is that the broom head is not firmly connected to the handle. This eventually wears the wooden threads until they fail. Another annoying trait of an ordinary broom head is that maneuvering it around obstacles can cause the handle to break quite easily. Clearly, what is needed is a different method for attaching the handle to the head, one that allows greater freedom of movement while increasing the overall durability. That is why the present invention has been conceived and developed. The present invention utilizes a coiled spring adjacent to the handle-to-head connection that provides superior flexibility for all sweeping tasks.

The present invention is constructed from a handle, a threaded section of handle material, and the coil spring. The handle is similar to other designs. It has a rounded end that is comfortable when pushed. The other end of the handle, however, is cut flat and even, forming the perfect shape for use with the spring. The spring is simply a coiled section of spring steel that flexes in any direction easily. The threaded section provides the means with which to attach any desired broom head. It also has one end cut flat for use with the spring and standard size threads on the other. The present invention is assembled by pressing or screwing the wooden pieces into the spring, leaving several turns open between them. The fit inside the spring is relatively tight to ensure a sturdy union.

Using the present invention is comparable to any other broom, but it is far more controllable and less prone to binding. If contact to furniture or other immovable obstacles is made, the present invention merely flexes back until the force is removed.

Obtaining truly suitable tools for use in the home can be extremely challenging with few retail stores offering competitive products to their industrial counterparts. With the present invention, brooms have been immediately improved without being overpriced.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved push broom with a flexible coupling in the handle comprising, in combination:

a head having a block at its upper extent and bristles at its lower extent, the block having a planar upper surface with a threaded aperture located at an angle offset from the perpendicular to the upper surface;

a handle formed as a rigid elongated cylindrical member having a long upper section adapted to be held by a user and having a short lower section, the lower end of the lower section being provided with screw threads for releasably coupling with the threaded aperture in the head, the lower end of the upper section being positioned proximate to the upper end of the lower section in alignment along a common axis with the facing ends thereof perpendicular to the common axis;

a coil spring coupling the lower end of the upper section with the upper end of the lower section, the spring having an upper extent frictionally receiving the lower extent of the upper section and a lower extent frictionally receiving the upper extent of the lower section with a central section of the spring located to encompass a space between the lower end of the upper section and the upper end of the lower section, the central section of the spring constituting about one third of the length of the entire spring;

a plurality of teeth formed into the spring in its area of engagement with its associated handle section;

an adhesive bubble formed of a rupturable membrane extending between the teeth of the spring with an adhesive liquid located therein adapted to be released upon the coupling of the spring to its associated handle section for the adhesive coupling therebetween; and a dye bubble formed of a rupturable membrane extending between an outer most tooth of the spring and an adjacent wall of the spring with a dye located therein whereupon securement of the spring to its associated handle section will break the rupturable member and release the dye to provide an indication that the spring is properly coupled to the handle section.

2. A broom with a flexible coupling in the handle comprising:

a head having a block at its upper extent and bristles at its lower extent, the block having a planar upper surface with a threaded aperture located at an angle offset from the perpendicular to the upper surface;

a handle formed as a rigid elongated cylindrical member having a long upper section adapted to be held by a user and having a short lower section, the lower end of the lower section being provided with screw threads for releasably coupling with the threaded aperture in the head, the lower end of the upper section being positioned proximate to the upper end of the lower section in alignment along a common axis with the facing ends thereof perpendicular to the common axis, said lower end and upper end being spaced from each other along said common axis; and a coil spring coupling the lower end of the upper section with the upper end of the lower section, the spring having an upper extent frictionally receiving the lower extent of the upper section and a lower extent frictionally receiving the upper extent of the lower section with a central section of the spring located to encompass the space between the lower end of the upper section and the upper end of the lower section, the length of the central section of the spring being substantially equal to the length of the space between the lower end and upper end of the respective upper and lower sections, the central section of the spring constituting about one third of the length of the entire spring, said spring having at each extent thereof a plurality of elements formed on and extending from an interior portion thereof in an area of engagement with each associated handle section.

3. The broom as set forth in claim 2 and wherein:

the plurality of elements are configured as teeth.

4. The broom as set forth in claim 3 and further including:

an adhesive bubble formed of a rupturable membrane extending between the teeth of the spring with an adhesive liquid located therein adapted to be released upon the coupling of the spring to its associated handle section for the adhesive coupling therebetween.

5. The broom as set forth in claim 3 and further including:

a dye bubble formed of a rupturable membrane extending between an outer most tooth of the spring and an adjacent wall of the spring with a dye located therein whereupon securement of the spring to its associated handle section will break the rupturable member and release the dye to provide an indication that the spring is properly coupled to the handle section.

* * * * *